United States Patent [19]

Lawrence

[11] Patent Number: 4,691,914

[45] Date of Patent: Sep. 8, 1987

[54] SHEET RECEIVER

[75] Inventor: Frederick J. Lawrence, Tustin, Calif.

[73] Assignee: Gradco Systems, Inc., Irvine, Calif.

[21] Appl. No.: 819,969

[22] Filed: Jan. 21, 1986

[51] Int. Cl.[4] ..... B65H 39/10

[52] U.S. Cl. ..... 271/297; 271/302; 271/305; 198/367; 198/442

[58] Field of Search ..... 271/297, 303, 305, 302, 271/186, 291; 270/55; 198/367, 442

[56] References Cited

U.S. PATENT DOCUMENTS 4,078,789 3/1978 Kittredge et al. ..... 271/186 X 4,256,299 3/1981 Hogenson ..... 271/302

FOREIGN PATENT DOCUMENTS 0048151 9/1978 Japan ..... 271/302

*Primary Examiner*—Joseph J. Rolla

*Assistant Examiner*—Gregory L. Huson

*Attorney, Agent, or Firm*—Newton H. Lee, Jr.

[57] ABSTRACT

A sheet receiver has a plurality of trays to receive paper sheets in a sequential or selected order as sheets are successively fed to the receiver from a source, such as a printer or copier, and transported to the inlet ends of the trays between opposing transport rolls which define a continuous straight paper path past the trays. Selected pressure or nip rolls are actuated from positions relative to feed rolls forming the straight path past the trays to positions relative to an adjacent feed roll to interrupt the straight paper path and form a nip at which the rolls are positioned to change the direction of sheet travel to direct a sheet into a tray.

6 Claims, 8 Drawing Figures

S 14
17
13
22
12
D
19
15
13
16
D
13
18
T
23
12
18
15
23
16
13
21
20

SHEET RECEIVER

BACKGROUND OF THE INVENTION

In the prior art, there are numerous machines for collating or sorting paper sheets as they are supplied from a source such as a printer or copier machine, wherein sheets are either selectively or sequentially transported from a supply of sheets to trays adapted to receive the sheets in collated or sorted sets or order. In certain of such collating or sorting machines, a sheet transport is provided to carry sheets to receiver trays, wherein, in the sheet path, deflectors or fingers are disposed to normally allow sheets to pass by a given tray, but upon actuation to a sheet deflection position, to deflect the sheet into a tray. An example of such a collator or sorter is exemplified in my prior U.S. Pat. No. 3,937,459 granted Feb. 10, 1976.

A travelling deflector has also been employed to direct sheets into successive trays from a path extending past the inlet end of the trays, as exemplified in Snellman U.S. Pat. No. 3,414,254 granted Dec. 3, 1968, and Raible et al U.S. Pat. No. 4,006,894 granted Feb. 8, 1977, and Arvett et al U.S. Pat. No. 4,216,955 granted Aug. 12, 1980.

Also it is known, as shown in Wentworth U.S. Pat. No. 2,328,317 to index a travelling transport past spaced trays to feed sheets into the trays.

Such prior devices have typically employed complex travelling belt systems to transport the sheets to the location at which they are fed into the trays, either by deflection of the sheet or by the beam strength of the sheet, as well as, in some cases, the velocity of the sheet.

In the Raible et al and Arvitt et al devices the sheets are positively driven into the trays by virtue of deflection of a belt type transport towards the inlet to the tray from a straight condition by a travelling device which causes the belt to form a feed path diverting the sheet into the tray.

SUMMARY OF THE INVENTION

The present invention combines and simplifies certain features of the prior art in such a manner as to produce a novel sheet transporting and diverting structure whereby the sheets can be driven into selected or sequential trays, so that the apparatus can be rapidly operated to provide random access to the trays, by use of novel deflector means providing selective nip points between opposing rollers which cause the sheet to be turned approximately 90° by the confronting feed rolls at the selected nip point into a tray from a straight path extending past the trays.

A modular construction is provided, whereby a selected number of drive roll and diverter units can be easily installed in a housing of selected height. Each feed roll unit has drive means adapted to cooperate with the drive means of another feed roll unit upon assembly into the housing.

DESCRIPTION OF THE PREFERRED EMBODIMENT

Figure 1:
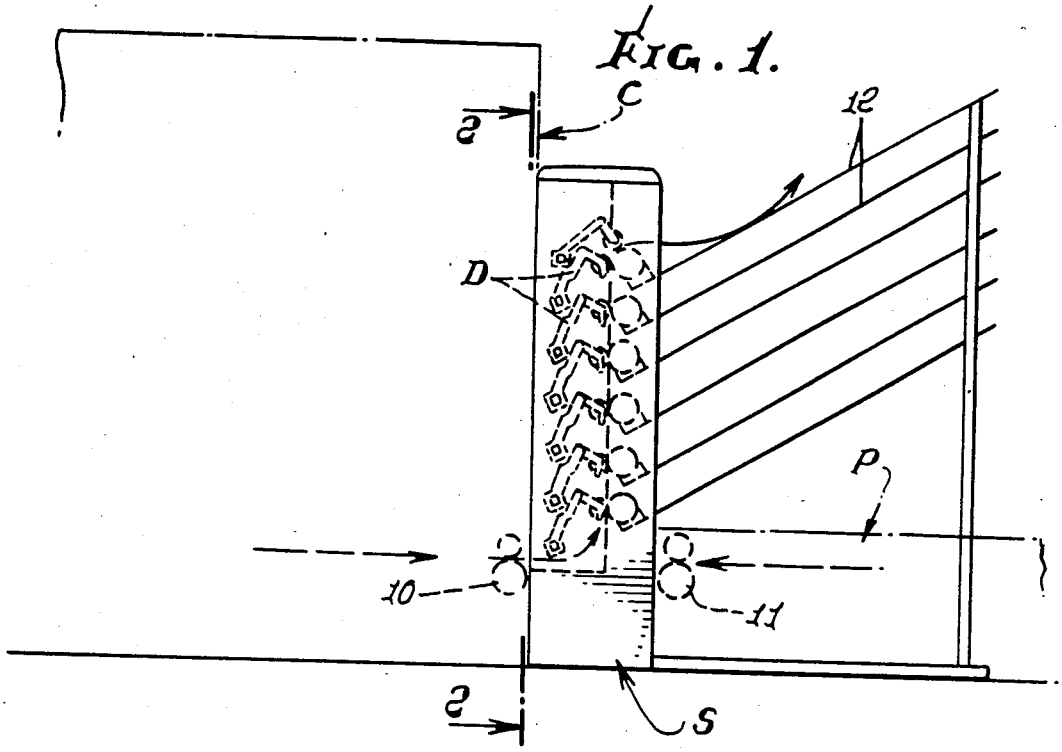
FIG. 1 is a side elevation of a sheet receiver in accordance with invention, showing in broken lines two supply devices.

As seen in the drawings a sheet receiver apparatus S is disposed to receive sheets of paper delivered from a source. For illustrative purposes, alternate sources are shown in broken lines in FIG. 1. On the left of the receiver S a photocopying machine or copier C is shown having outlet feed roll means 10 for directing sheets, as indicated by the arrows, to the receiver S. At the right of the receiver another source of sheets is shown in broken line and is referred to herein as a printer P having outlet feed roll means 11.

Receiver S has a plurality of sheet receiving trays 12 into which sheets are to be directed by sheet diverted means D, as the sheets are supplied to the receiver S and moved through a transport system T which includes the diverter means.

Figure 2:
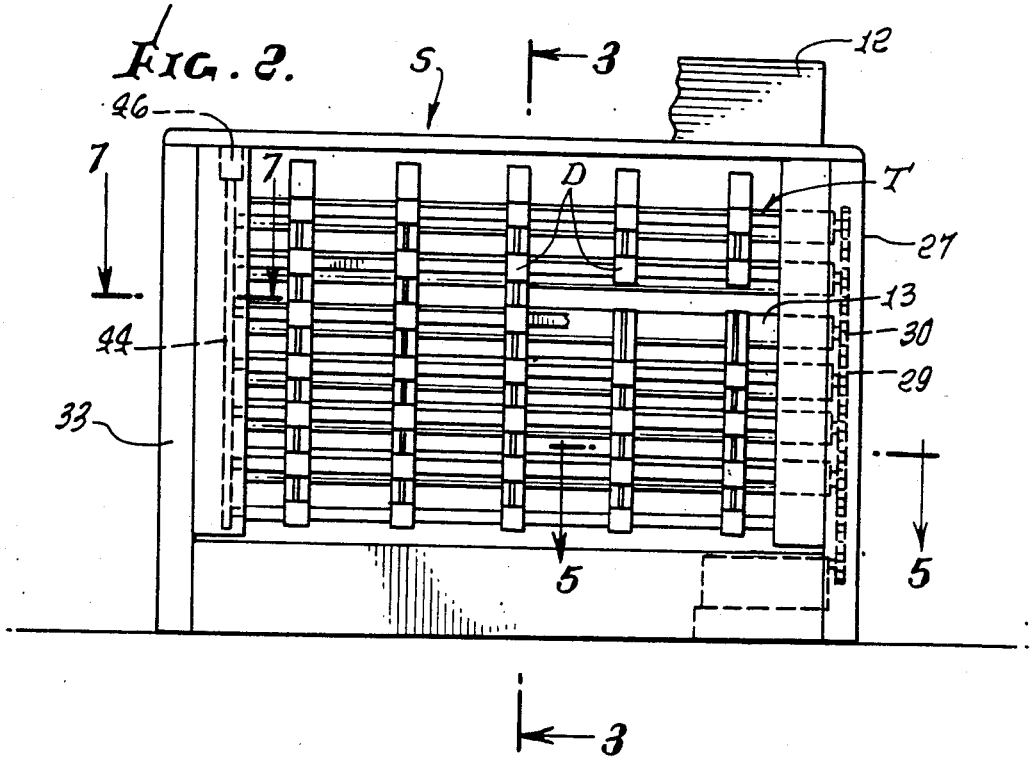
FIG. 2 is a rear elevation of the sheet receiver, taken on the line 2—2 of FIG. 1, and on an enlarged scale.
Figure 3:
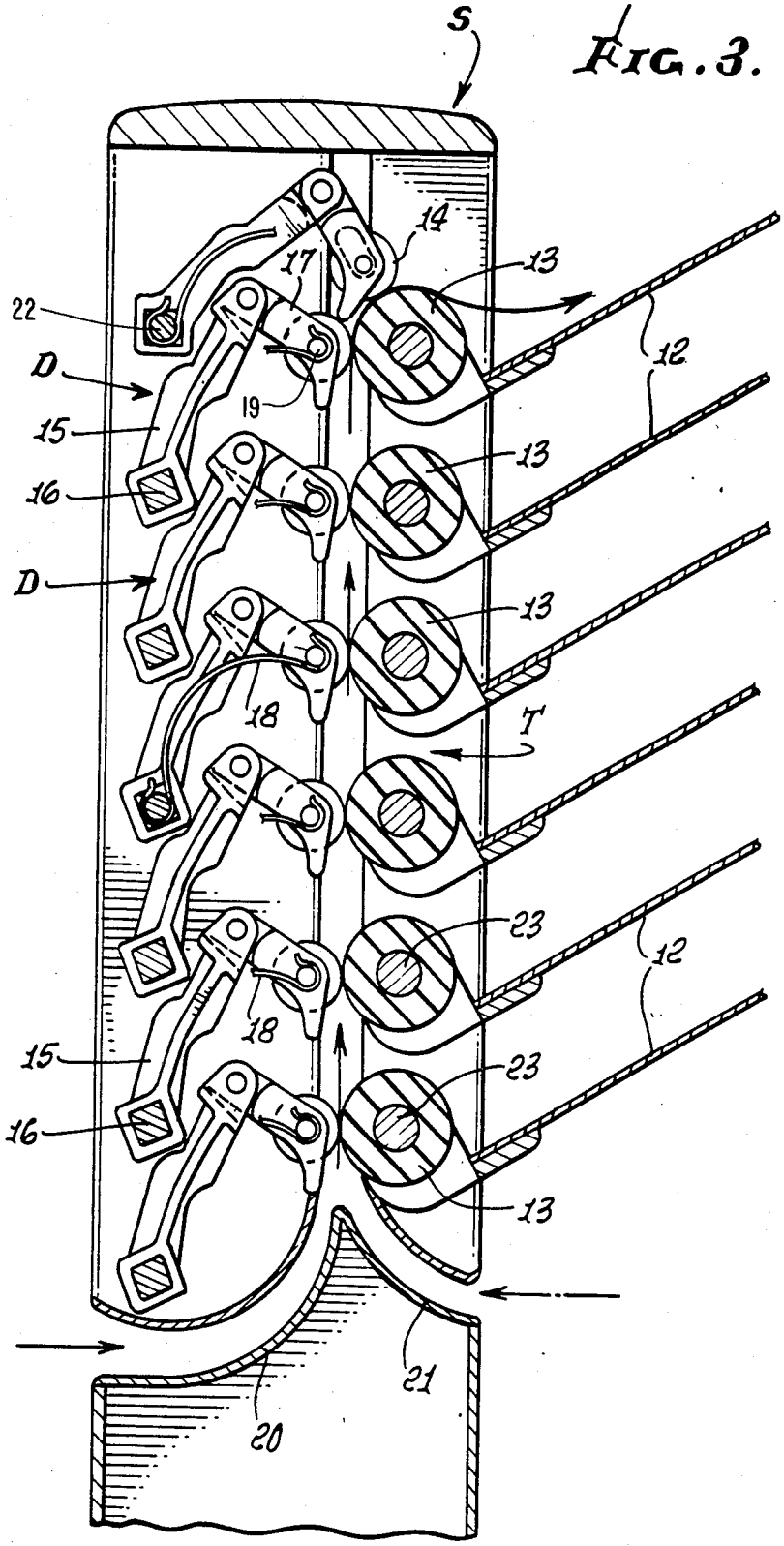
FIG. 3 is an enlarged vertical section on the line 3—3 of FIG. 2.

Referring to FIGS. 2 and 3, the transport means T comprises a set of horizontally extended and vertically spaced drive roll assemblies 13, the peripheries of which are on a common vertical plane. The drive rolls 13 are opposed by a number of vertically and horizontally spaced nip rolls 14, all except the uppermost of which normally have the outer peripheries vertically aligned on the same vertical plane as the drive rolls 13, so as to oppose the latter and apply pressure to a sheet of paper as it is being moved between the drive rolls and the nip rolls. The nip rolls 14 are incorporated in the diverter means D. Each diverter means D, except for the uppermost one of them, includes a number of horizontally spaced lever arms 15 respectively mounted upon a horizontally extended rock shaft 16, which, as will be later described, is adapted to be angularly moved to effect diversion of the sheets into selected or respective trays 12. At the outer end of each lever 15 is a pivoted arm 17 in which the nip rolls 14 are rotably supported. Suitable springs, such as leaf springs 18 which are disposed, in the illustrative embodiment, between the rock shafts 16 and the nip roll supporting shafts 19 to normally bias pivot arms 17 towards the drive rolls 13, while, as will be later described, enabling the rock shafts 16 to be actuated in a clockwise direction as viewed in FIG. 3 to effect a change in the angular relation of the axes of the nip rolls and the drive rolls, from the normal horizontal alignment as shown in FIG. 3, thereby changing the nip point.

As seen in FIG. 3, the receiver apparatus has an inlet guide structure 20 adapted to receive successive sheets supplied from copier C and to direct the sheets in an upward direction to be engaged between the lowermost drive roll and nip roll. In the alternative, the structure is such that a second guide structure 21 is provided to receive sheets from the printer P to direct the sheets upwardly to the lowermost nip and feed rolls. Sheets engaged between the lower most nip and feed rolls are transported in a straight path vertically past all of the trays 12, except the uppermost of the trays, when the diverters D, except for the uppermost diverter, are in the normal positions of FIG. 3. At the uppermost feed rolls 13 the uppermost diverter is mounted upon a stationary shaft 22, so that the uppermost nip roll is always biased towards the uppermost feed roll to cause the travel of the sheet to be altered from the straight vertical path to a horizontal path, whereby the sheet is deflected into the uppermost tray. As a result, if the receiver apparatus is being employed in association with the copier C and the receiver is being operated in a non-sort mode, then each successive sheet will be carried from the inlet guide 20 to the uppermost tray 12, and all sheets will be stacked in the latter.

Figure 4:
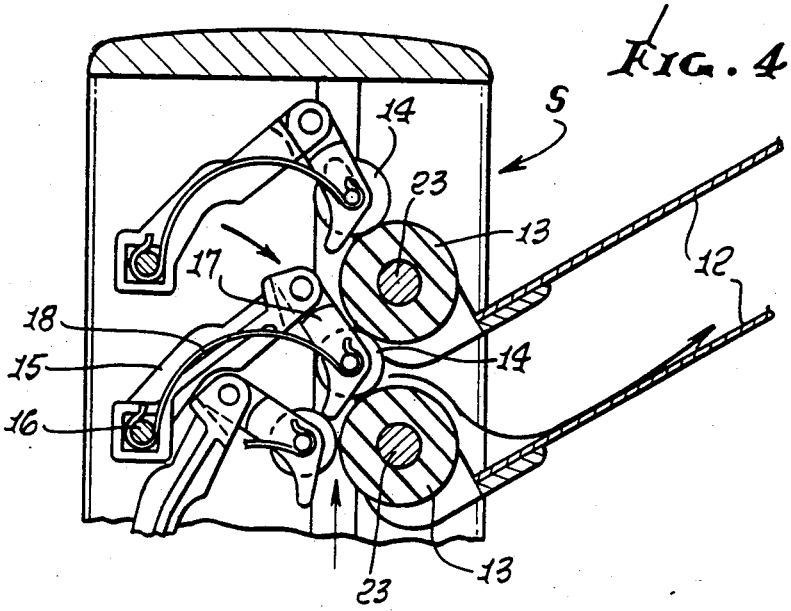
FIG. 4 is a fragmentary detail view, showing a diverter moved to a position to direct a sheet into a selected bin.

In the sorting mode of operation, assuming that the sorting operation is in a downward direction from the uppermost tray to the lowermost tray, the deflectors are sequentially actuated, as will be later described, so that the diverters are rocked in the clockwise direction to move the nip roll 14 of the second from the upper diverter downwardly, as seen in FIG. 4, into confronting drive relation with the second from the uppermost drive roll 13, whereupon, the next sheet to move upwardly through the transport will be diverted from the vertical path to substantially a horizontal path and be driven into the second from the uppermost tray. The same sequence of events will cause the following sheets to be sequentially fed into the successive lower trays as successively lower diverters are actuated.

In the alternative, in the case that the sheets are being fed from the printer P to the inlet guide 21, the sheets will also be fed upwardly in the straight path between the successive drive and nip rolls, but, as will be later described, the rock shafts 16, under these conditions, may be actuated selectively and/or randomly, whereby the sheets may be fed into any selected tray 12. By the same token, it will be observed that sheets entering the guide 21 with printed matter on the upper surface will be inverted as they exit the respective diverters so as to enter the trays face down, as is preferred in the case of printers capable of feeding printed matter face up commencing with the first and concluding with the last of a set of printed pages.

Figure 5:
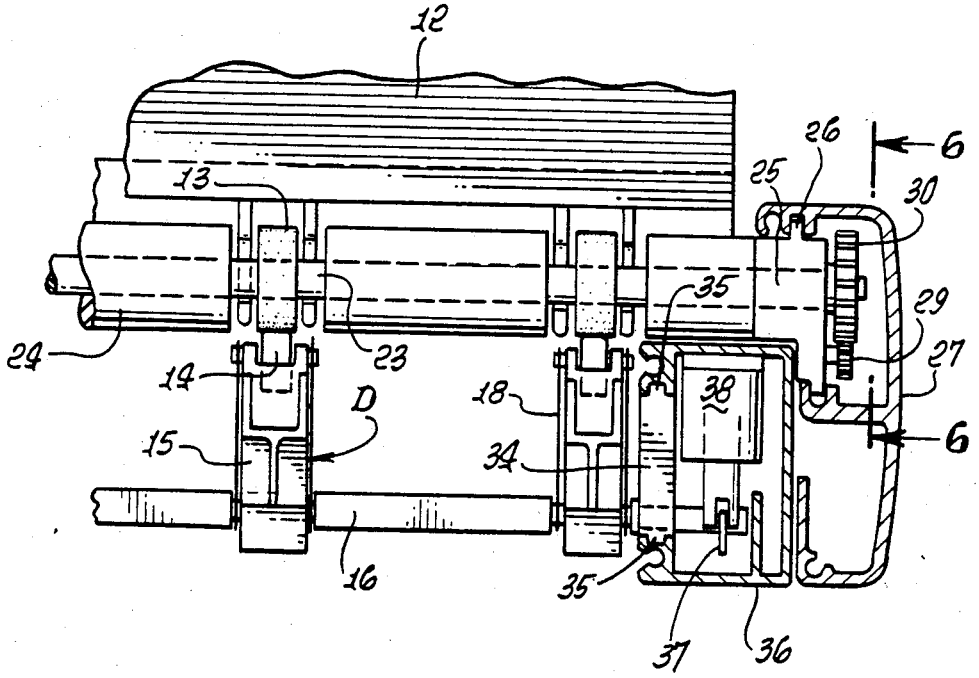
FIG. 5 is an enlarged, fragmentary horizontal section on the line 5—5 of FIG. 2, showing an actuator means to shift a selected diverter to a sheet diverting position.
Figure 6:
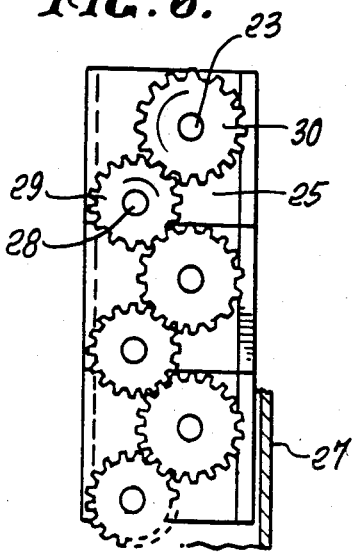
FIG. 6 is a fragmentary vertical section on the line 6—6 of FIG. 5, showing the paper feed drive.
Figure 8:
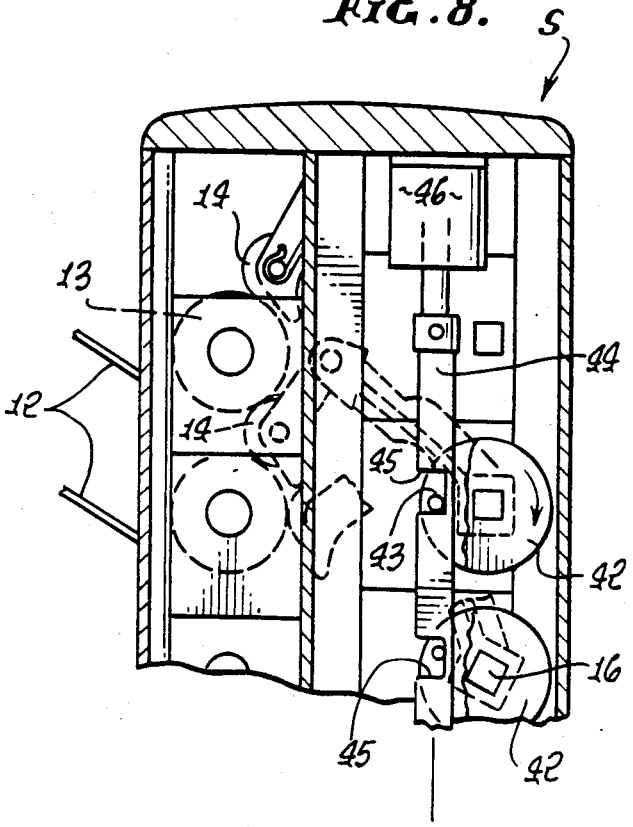
FIG. 8 is a vertical, fragmentary section on the line 8—8 of FIG. 7.
Figure 7:
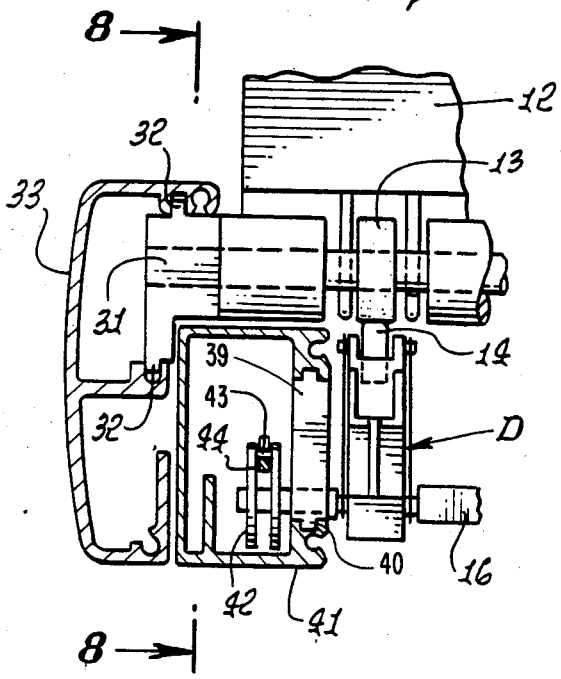
FIG. 7 is an enlarged fragmentary, horizontal section on the line 7—7 of FIG. 2, showing the diverter retracting means.

Referring to FIGS. 5 and 7, it will be seen that in the preferred form the drive rolls 13 are mounted upon tranversely extended shafts 23, and preferably consist of resilient material to enhance frictional engagement of a sheet between the drive rolls and the nip rolls. Also installed upon shaft 23 between the drive rolls is a number of cylindrical members 24 which are provided to substantially bridge the space between the drive rolls, thereby confining the sheets to a vertical path and inhibiting flexure of the sheets between the drive rolls. The drive rolls 13 and the cylindrical members 24 are shown as separate elements on the shaft 23, but it will be apparent that these elements may be molded of the same material upon the shaft 23. In the form shown in FIG. 5, the right hand end of each shaft 23 extends through a mounting block 25 formed with flanges 26 which are adapted to extend into companion elongated grooves which may be provided in a convenient form in a vertically extended extruded housing 27. As best seen in FIG. 6, each block 25 accommodates the shaft 23 and also supports a shaft 28 on which is rotably supported an idler 29 in mesh with the drive gear 30 on the shaft 23. Accordingly, any suitable number of the assemblies of shafts and blocks 25 can be utilized in the housing extrusion of a selected height, and, on assembly, the idler and drive gears are meshed.

Correspondingly, at the left of the receiver, as shown in FIG. 7, the shafts 23 are rotably supported in an end block 31 having flanges 32 adapted to be received in vertically extended grooves in a housing extrusion 33, whereby, the structure is truly modular.

Means are provided for rocking the respective rock shafts 16 in opposite directions to the respective positions illustrated by the second and third from the uppermost deflectors D shown in FIG. 4. As seen in FIG. 5, the right hand end of the rock shaft is supported in a support block 34 having flanges 35 adapted for engagement in companion slots in a vertically extended extrusion 36. Within the extrusion 36 the shaft 16 has a crank arm 37 engaged by a solenoid 38 adapted to be energized to move the rock shaft from a normal position of a deflector D to the position at which it is operative to divert a sheet into a tray. It will be understood without repetitive illustration that each rock shaft 16 is provided with a solenoid 38. At the other side of the receiver, as seen in FIG. 7 each rock shaft extends through another support block 39 having flanges 40 for engagement in companion grooves in another extrusion 41, at the left end of the respective rock shafts. In addition, within the extrusion 41, each rock shaft 16 has a disc structure 42 fixed thereon and having a pin 43. An elongated actuator member 44 having notches 45, extends vertically through each disc structure 42 and a pin 43 of each disc structure is disposed in the notch 45. At its upper end the actuator member 44 is connected with a solenoid 46, whereby retraction of the solenoid armature will cause the actuator member to engage the respective pins 43 of each rock shaft which has been actuated in the direction to deflect a sheet from normal position, as described above. This actuator structure further enables the receiver to place sheets randomly in selected trays, in the operating sequence which involves actuation of a selected rock shaft or any subsequent upper rock shaft and thereafter operating solenoid 46 to retract the deflectors to allow the transport of a sheet to the tray above.

It will be noted in connection with the above described operation of the rock shafts, that when a diverter is shifted from the normal position opposed to one feed roll 13 to a position to effect engagement of the nip roll 14 with the next feed roll below, the springs 18 maintain continuing pressure engagement of the nip roll with the feed roll, so that the nip roll travels downwardly about the periphery of the upper feed roll until it is also in engagement with the lower feed roll. At this point the force of springs 18 tends to normally hold the nip roll between the adjacent feed rolls.

From the foregoing, it will be recognized that the sheet feeding and diverting structure of the present invention is very simple in that, among other things, the use of endless belts and travelling nip points are eliminated, but the sheet is at all times positively engaged between the feed and nip rolls, virtually until the sheet is deposited in the tray. No provision must be made for extension of belts, deflection of belts, or other means for maintaining frictional drive between sheet feed members is required. The structure is well suited to sequential, top to bottom or bottom to top actuation of the diverters, as in the case of typical sorting or collating of sets and sheets. In addition, the structure is also well suited to the random actuation of the diverters, so that the apparatus functions as a pigeon holing receiver in which a desired number of sheets can be directed to selected trays.

What is claimed is:

1. Sheet receiver apparatus comprising: a frame structure, a plurality of trays in spaced relation to receive sheets, sheet transport means in said frame structure to carry sheets by a straight path from an inlet past ends of said trays, said transport means including a plurality of driven sheet feed rolls and sheet diverters having nip rolls opposing said feed rolls, said feed rolls and said nip rolls normally being in positions confronting one another on a common plane extending between said feed and nip rolls and defining said straight path, means for actuating said diverters to move between said normal position and a position at which the nip roll is confronting a next adjacent feed roll and is offset from said plane towards a tray, whereby a sheet is diverted from said straight path into a tray.

2. A sheet receiver as defined in claim 1; wherein said diverter means include a lever, an arm pivoted on said lever, a nip roll on said arm, means for resiliently moving said arm towards a feed roll, and actuator means for moving said lever and nip roll towards and away from said position confronting a next adjacent feed roll.

3. A sheet receiver as defined in claim 2, wherein said actuator means include a plurality of solenoids selectively operable to move said diverters between said positions.

4. A random access sheet receiver comprising: a vertically extended frame structure, a plurality of vertically spaced and horizontally extended trays supported by said frame structure, sheet transport and diverter means horizontally extended in said frame structure including a plurality of driven shafts having feed rolls mounted thereon with their peripheries on a common vertical plane, nip rolls normally disposed in opposition to said feed rolls with the axes of the nip and feed rolls on a common horizontal plane, support means for supporting said nip rolls and selectively operable to move selected nip rolls from said normal position to a position in opposition to the next adjacent vertically spaced feed rolls with the axes of the selected nip rolls and said next adjacent feed rolls on a common plane at an angle to said horizontal plane to cause deflection of a sheet into a tray, and means to selectively actuate said support means.

5. A random access sheet receiver as defined in claim 4, including spring means acting on said nip rolls to maintain said nip rolls in continuous opposition to said feed rolls during movement of said nip rolls.

6. A random access sheet receiver as defined in claim 4, including operating means to return said support means simultaneously to said normal position.

* * * * *